US009010797B2

(12) United States Patent
Elliott

(10) Patent No.: US 9,010,797 B2
(45) Date of Patent: Apr. 21, 2015

(54) CLIMBING SKIN PLATES

(75) Inventor: Scott Elliott, Center Ossipee, NH (US)

(73) Assignee: Elevation Ski Technologies, Inc., Center Ossipee, NH (US)

( * ) Notice: Subject to any disclaimer, the term of this patent is extended or adjusted under 35 U.S.C. 154(b) by 389 days.

(21) Appl. No.: 13/196,620

(22) Filed: Aug. 2, 2011

(65) Prior Publication Data

US 2012/0161423 A1 Jun. 28, 2012

Related U.S. Application Data

(63) Continuation-in-part of application No. 12/977,108, filed on Dec. 23, 2010.

(51) Int. Cl.
*A63C 5/00* (2006.01)
*A63C 7/04* (2006.01)

(52) U.S. Cl.
CPC ..... *A63C 7/04* (2013.01)

(58) Field of Classification Search
CPC ..... A63C 5/0428; A63C 7/00; A63C 7/02; A63C 7/04; A63C 7/06; A63C 5/06; A63C 7/12; A63C 2203/00
USPC ..... 280/604, 601, 603, 611, 618, 809, 817, 280/605
See application file for complete search history.

(56) References Cited

U.S. PATENT DOCUMENTS

| | | | | | |
|---|---|---|---|---|---|
| 1,783,833 | A * | 12/1930 | Elsner | 280/604 |
| 2,149,585 | A * | 3/1939 | Dawson | 280/604 |
| 2,162,888 | A * | 6/1939 | Held et al. | 280/604 |
| 2,189,760 | A * | 2/1940 | Matthee et al. | 280/604 |
| 2,287,252 | A * | 6/1942 | Kaufmann | 280/604 |
| 2,326,802 | A * | 8/1943 | Robinson et al. | 280/604 |
| 2,358,213 | A * | 9/1944 | Courage | 280/604 |
| 3,506,279 | A * | 4/1970 | Lambert | 280/826 |
| 4,666,178 | A * | 5/1987 | Matthews | 280/604 |
| 5,052,708 | A * | 10/1991 | Matthews | 280/604 |
| 6,105,990 | A * | 8/2000 | Sutherland | 280/604 |
| 6,264,215 | B1 * | 7/2001 | Carlson et al. | 280/14.21 |
| 6,471,234 | B2 * | 10/2002 | Ayliffe | 280/604 |
| 6,604,755 | B2 * | 8/2003 | Ayliffe et al. | 280/604 |
| 6,837,512 | B2 * | 1/2005 | Long | 280/604 |
| 7,287,775 | B2 * | 10/2007 | Walker et al. | 280/604 |
| 7,540,525 | B2 * | 6/2009 | Ametsbichler et al. | 280/604 |
| 7,543,839 | B2 * | 6/2009 | Hartmann | 280/604 |
| 7,681,904 | B2 * | 3/2010 | Ekberg | 280/603 |
| 8,474,853 | B2 * | 7/2013 | Rogers et al. | 280/604 |
| 8,590,936 | B2 * | 11/2013 | Payson | 280/809 |
| 8,844,963 | B2 * | 9/2014 | McCrank et al. | 280/604 |
| 2006/0267332 | A1 * | 11/2006 | Fischli | 280/809 |
| 2007/0246913 | A1 * | 10/2007 | Coulbourn | 280/604 |
| 2008/0023956 | A1 * | 1/2008 | Fischli | 280/809 |
| 2008/0185817 | A1 * | 8/2008 | Gyr | 280/604 |

* cited by examiner

*Primary Examiner* — J. Allen Shriver, II
*Assistant Examiner* — James M Dolak
(74) *Attorney, Agent, or Firm* — Catherine Napjus

(57) ABSTRACT

The present invention includes a modified ski and climbing skin plate kits. The climbing skin plate kit is for use with a ski and includes at least one rigid plate, at least one front bracket, and at least two protrusions. The modified ski includes a ski and two protrusions protruding from either side of the ski.

18 Claims, 16 Drawing Sheets

CLIMBING SKIN PLATES

CLAIM OF PRIORITY

This application is a continuation in part of co-pending U.S. Non-Provisional patent application Ser. No. 12/977,108, filed on Dec. 23, 2010.

FIELD OF THE INVENTION

The present invention relates to climbing skins, and in particular, to climbing skins attached to a rigid plate that is easily removable and replaceable from a ski.

BACKGROUND

Back country skiing is a popular recreational activity in mountainous regions around the world. As back country skiing requires the ability to climb up mountains, measures must be taken to increase the grip of the ski. This is commonly accomplished by attaching climbing skins to skis. Most current climbing skins are non-rigid and foldable. One side of the climbing skin, that will face the ground when the climbing skin is in use, is covered in a snow adhering substance, such as mohair, which provides traction for the ski. The other side of the climbing skin is glued to the base of the ski. Finally, the climbing skins are further attached to the tip and tail of a ski. When the climbing skins are so attached, they are in "climb mode." Currently, climbing skins are the best way to ascend while back country skiing.

Climbing skins have significant disadvantages, however. The primary disadvantage is that they are difficult to remove and apply. During a descent, or during "ski mode," i.e. when the skis are being used normally, without climbing skins attached, the climbing skins are folded up so that the glued side of the skins are facing each other. If they are not kept close to the body so that the glue remains warm, they may lose their stickiness during the descent. In any scenario, however, the skins are difficult to pull apart as they have essentially been glued together. Once the skins are unfolded, the user's ski must be removed in order to glue the skin to the base of the ski and attach the skin at the tip and tail of the ski. Depending on the depth of the snow, removing skis can result in "post holing," or sinking into the snow, which is, at best a nuisance, and at worst, a serious safety concern. Moreover, in any depth of snow, removing skis can result in the buildup of snow on the bottom of the boot, making it difficult to lock the boot back into the ski binding. When the climb is completed, the user must again remove his skis, remove the skins, fold the skins, place the skins close to his body for body heat for the next use, and put his skis back on. Especially for small mountains that require short climbs, followed by short descents, and then short climbs again, etc . . . , this process becomes very time consuming, and indeed, takes up a large percentage of the overall time spent back country skiing.

In addition, this process only works for as long as the climbing skins' glue remains effective. Several factors can affect this. As mentioned above, if the glue is too cold, it may lose its stickiness, and potentially make it impossible to unfold the climbing skins at all. Also, every time an application or removal of the skins occurs, the glue is exposed to debris from the user's hands and apparel, as well as the outdoors in general. The more debris that sticks to the glue, the less effective the glue will be at sticking to the ski. Finally, climbing through wet areas, such as brooks, will also cause the glue to lose its stickiness.

A few existing products attempt to address some of these issues by eliminating the need for glue. U.S. Pat. App. No. 2008/0185817 to Gyr discloses bonding mohair to flexible cambered plates and cinching these plates against a ski base with straps or snaps. Although this product eliminates glue, some of the difficulties in applying and removing the product remain. Specifically, the user must still remove his ski to properly align the ski with the product and to attach the product to the tip and tail of the ski. Moreover, the snaps and straps contemplated may be difficult to manipulate, especially when the user is wearing thick or bulky gloves or mittens. Finally, it is not clear that the snaps and straps will adequately hold the cambered plates against the ski. U.S. Pat. No. 6,471,234 to Ayliffe and U.S. Patent No. 2010/0140901 to Rogers et al, disclose apparatuses designed to aid in attaching climbing skins to skis, but also do not address all of the issues discussed above.

Thus there is a need for a climbing skin that does not use glue and that is easily applied to and removed from the ski without necessitating removal of the ski.

SUMMARY OF THE INVENTION

The present invention includes climbing skin plates, climbing skin plate kits, and a modified ski.

In their most basic form, the climbing skin plates of the present invention include rigid plates, a front bracket, and a binding system. The plates will be fixedly placed against the base of a ski, as described below. The plates may be made of any durable essentially rigid material, such as steel, aluminum, fiberglass, plastic, or wood. Lighter materials are preferred. The length of the plates should be at least slightly longer than the user's ski boot in bindings. The length of the plates may vary and/or be customized by the user. The longer the plate, the more grip the user will have on the snow, but the more bulky the plates become themselves. As discussed below in more detail, some plates may be made of multiple sections, and a three section unit could be as long as 3 feet. The width of the plates also may vary and/or be customized to accommodate different sized skis. In the preferred embodiment, the plates include a snow adhering substance bonded or adhered to one side of the plates. The snow adhering substance is preferably mohair, but may be any snow adhering substance commonly used in the art of climbing skins. In some embodiments, however, the plates do not include the snow adhering substance, and users may glue sections of existing climbing skins to the plates.

In embodiments in which the plates include a snow adhering substance, the bottom of the plates may be finned to aid in grip while climbing. The snow adhering substance may or may not cover each fin in addition to the bottom of the plates. The fins are preferably steel and project downward from the bottom of the plates. The fins may run vertically down the length of the plate or horizontally across the width of the plate. When the fins run horizontally across the width of the plate, the fins may be perpendicular to the plate, but it is preferred that they form an angle of between 15° and 45° with the bottom of the plate, to better aid in gripping during climb mode. In a variation on the fins that run horizontally across the width of the plate, the fins may be wishbone shaped across the width of the plate. In this variation, the wishbone shaped fins may also be perpendicular to the plate, but it is also preferred that they form an angle of between 15° and 45° with the bottom of the plate. Any of the fins styles described above may be integral to the plates or may be removable attachments.

The bottom side of the plates may be rounded to increase surface area. For example, the bottom side may be a half cylinder, rather than flat, or otherwise curved to a lesser extent. Moreover, the plates may be formed similar to a ramp so that the front of the plates meet the bottom of the ski or the bottom of the diverter spring and then become steadily thicker toward the back of the plates, so that the back of the plates are approximately 1 inch thick. Such adjustments to the plates to increase surface area or otherwise enhance grip without using fins may be preferable to using fins as fins may partially inhibit gliding movement with the plates.

The plates preferably consist of one to three sections. Plates containing more than one section may be folded up for compactness and ease of storage and/or carrying. If the plates consist of two sections, they will include one foldable connecting device, such as a hinge. If the plate consists of three sections, they will include two foldable connecting devices, such as hinges. Although hinges are the preferred foldable connecting device, one of ordinary skill in the art will recognize that many similar devices capable of performing the same function as a hinge may be substituted and are included within the present invention. Having at least one foldable connecting device may be preferable so that the plates may be made more compact for transport and storage. When the plates are sectioned, they may include rubber stops at the foldable connecting device, which are rubber strips along the edges of the plates between the foldable connecting devices that alleviate some of the stress on the foldable connecting devices when the plates are folded out. With no pressure applied, the sectioned plates fold out to approximately 178°.The rubber stop allows the sectioned plates to extend to 180° when applied to the ski. When the plates are sectioned, they may also include a locking device to be applied to each foldable connecting device to assist in holding the plates open and to make the opened sectioned plates one solid unit.

The plates may also include a diverter spring, steel edges, and/or hand holds. The diverter spring is a preferably rectangular piece attached to the front of the plate, diagonally spanning the short distance between the bottom, front edge of the plate and the base of the ski. The purpose of the diverter spring is to avoid snow buildup in front of the plate. The diverter spring is preferably made of the same rigid material as the plate, but preferably includes a material, such as a snow adhering substance, adhered or bonded to the bottom side of the diverter plate so that it is not slick against the snow during climb mode. If the plate is sectioned and includes a diverter spring, it is preferable that the rear section or sections be slightly longer than the front section so that the rear section(s) come beyond the diverter spring when the plates are folded up. In this manner, the rear section(s) protect the diverter spring during ski mode. In some preferred embodiments, the diverter spring is not a separate piece, but is merely a cutting away of the front edge of the plate at an angle so that snow is guided below the rigid plate rather than between the rigid plate and the ski.

Steel edges along the length of the plates may be included to provide additional grip for particularly icy conditions. Hand holds are areas on each section of the plate that are slightly indented so as to be easily held in hand. This embodiment is generally not preferred as it reduces the area that the snow adhering substance will cover, but may be preferred for users who prefer to carry the plates in their hands. Hand holds may also be useful when the user will be skiing down only very short descents and may need to apply the plates with little time between applications. Under such circumstances, it may be less of a nuisance to just hold the plates, rather than affix them to the user's person or otherwise store them.

In some embodiments, the plates may include one or more removable crampon attachments. Such crampon attachments would mount on the top of the plates and hang down below the plate. The crampons attachments are preferably made of steel and shaped like fins. The crampon attachments would provide extra grip when needed. If one crampon attachment were used, it would preferably be placed toward the rear of the plate, near the user's heel. In situations where the user needs a great deal of additional grip, he may use two crampon attachments per foot, with one near the heel and one farther toward the front of the plate, thus spanning almost the entire plate.

The front bracket is a bracket integral to the front of the plate. The front bracket may include two side brackets that are bolted into either side of the plate. If the front bracket is attached to the plate in this manner, the front bracket may be adjustable by countersinking the bolts into the brackets and setting them on slotted tracks. The front bracket may also include two sides connected by a base that spans across the width of the plate and is attached across the width or incorporated within the height of the plate. These are but two examples of how the front bracket may be attached to the plate, but one of ordinary skill in the art will recognize that there are many ways in which the front bracket could be attached to the plate and each of these ways is contemplated as being a part of the present invention.

The front bracket acts both as a guide for the ski into the front bracket, and as a means for holding the plate tightly against the ski. The front bracket may be made of the same rigid material as the plate. The front bracket extends up from either side of the plate, preferably between ½ and 1 inches. As the plate is commensurate in width with the ski, the front bracket extends snugly on either side of the ski. The front bracket includes a pin hole on either side of the front bracket that extends above the ski. The binding system, discussed below, operates such that a pin is extended above the ski, through each pin hole, thus holding the ski closely to the plate. The front bracket may be permanently integral to the plate, or may be attached to the plate by countersunk bolts or other art recognized means for attachment that allow the adjustment and/or optional removal of the front bracket.

It is preferred that the pin hole be placed toward the back of the front bracket for two reasons. First, this allows the user to place his foot down anywhere on the plate in front of the pin holes and then simply slide his foot back until the pins catch the pin holes. To further this advantage, both the pin hole and the pin may be tapered so as to engage with one another more easily. Second, especially in those embodiments that include a spring diverter, the farther back the pin binding is on the ski, the closer the plate is held to the ski and the more the plate and snow adhering substance attached to the plate are located under the user's foot, where they are most needed. It is preferred that the pin holes be elongated vertically into an oblong shape. This way, if the pins are not perfectly vertically aligned with the pin holes when the user is applying the plates to the skis, the pins may be caught at lower or higher heights and guided into the center of the pin hole, which is the only point of the oblong wide enough to hold the pin and thus hold it securely in place. It is also preferable that the area of the front bracket that is in front of the pin hole be slightly bent or tapered away from the binding system, while the area of the front bracket that is behind the pin hole remain in the original plane, parallel to the binding system and ski. This allows the pins to begin to open before they reach the pin holes, making it easier for the pins to lock into the pin holes, while holding the ski firmly in place behind the pin holes.

In some embodiments, the present invention also includes a rear bracket. The rear bracket is integral to the plate toward the rear of the plate and attached to the plate in any of the ways described above with respect to the front bracket. The rear bracket acts as a further guide to keep the ski in position and to provide lateral support when needed. It is preferred that the rear bracket, when present, extends about ¼ inch up from the plate on either side of the ski. In some embodiments, where it is preferable to have the rear bracket aid in holding the plate against the ski, one side of the rear bracket may be acutely angled toward the other side of the rear bracket so that the ski is somewhat clipped in the rear bracket when placed within the rear bracket, but the ski may still be easily removed from the rear bracket by angling the ski after unlocking the front bracket. Like the front bracket, the rear bracket may be permanently integral to the plate, or may be attached to the plate by countersunk bolts or other art recognized means for attachment that allow the adjustment and/or optional removal of the front bracket. Both front and rear brackets may be slightly flared at the top for ease of placing the ski within their width before guiding the skis to a snug fit at the bottom of the brackets.

The binding system is permanently or removably mounted to the ski. Several binding systems have been contemplated by the inventor and are listed here and described in detail below. One of ordinary skill in the art will recognize that the binding systems described herein are but a few examples of such binding systems and many other similar types of binding systems may be substituted within the spirit of the present invention. Each binding system includes a binding plate, spring mechanism, and pins. The binding plate is mounted on the ski in front of the ski binding, i.e. between the tip of the ski and the area covered by the boot. The binding plate may come in various thicknesses so that the working parts of the binding system are a consistent height off of the ski so as to engage the pin hole of the front bracket. Shims may be provided with the binding plate to achieve this correct height and to stabilize the binding plate on rounded skis, for example. In the preferred embodiment, the binding plate is permanently mounted on the user's ski. In an alternate embodiment, the binding plate may be snapped into place on the ski, and is thus removably mountable.

The spring mechanism is integral to and mounted upon the binding plate. In a preferred embodiment of the spring mechanism, two round pins with arms that will lock into the pin holes of the front bracket will be spring loaded with the spring between the pins. The pins protrude from either side of the binding plate. When the plates are being applied to skis, the spring extends and the pins are released so that they lock into the pin holes of the front bracket. When the plates are being removed from the skis, the spring is compressed as the pins are pinched together and rotated down so that the pins are locked into the spring mechanism. In this position, the spring mechanism and pins are narrower than the front bracket so that the ski may be removed from the front bracket unhampered. Preferred springs include a compression-type spring extending between the two pins; two compression-type springs between the pins, one for each pin; or a flat, wish-bone style spring.

In an alternative embodiment of the present invention, a riser plate is included. The riser plate mounts between the ski and the binding. The riser plate includes pins extending from either side that engage with the holes of the front bracket, as described above. In this embodiment, the user will step into the front bracket so that it comes up on either side of his foot/boot, rather than the front bracket being positioned in front of his foot as in embodiments described above. In addition to the front bracket in this embodiment being positioned farther back with respect to the user's foot, the front bracket may also be positioned farther back with respect to the climbing skin plate so that the front bracket is more centered on the climbing skin plate than at the front of it, in a center area of the climbing skin plate. Whether the pins are retracted or extended is controlled by a pin moving device, which is operable by a pin moving device operator. In a preferred embodiment, the pin moving device is a spring mechanism, as described above, but housed within the riser plate between the two pins. The pin moving device operator for the spring mechanism is a locking mechanism attached to the binding plate, which is mounted in front of the ski binding as described above. The spring mechanism and locking mechanism are preferably connected by wires in a closed loop. The user manipulates the locking device to lock the spring mechanism within the riser plate, which, in turn, locks the pins extending from the riser plate into an extended or non-extended position. In an alternative automated embodiment, the pin moving device is a set of two actuators housed within the riser plate between the two pins. The pin moving device operator is a device with a switch for extending or retracting the actuators. The device may be physically wired to the actuators within the riser plate, and mounted on the riser plate. The device may also be in wireless communication with the actuators so that the device may be handheld so that it may be placed in a pocket, held in the hand, or otherwise attached to the user's person, within easy reach of the user. This embodiment does not include a rear bracket. This embodiment including a riser plate holds the climbing skin plate closely to the ski directly under the foot, where the snow adhering properties of the climbing skin are most needed. This embodiment may include features as described above, such as fins, a snow diverter, steel edges, or handholds.

In another alternative embodiment, the pins as described above are substituted with preferably rounded protrusions, such as bullet catches or friction catches. These protrusions may be applied to either side of a ski or a binding plate mounted on top of a ski. In the case of the preferred bullet catches, the round protrusion is attached to a short shaft inside of which is a spring so that the protrusion is retractable within the shaft. The total length of the preferred bullet catch is preferably approximately 7/16 of an inch, with an approximately ¼ inch diameter. The shaft, which is approximately 5/16 of an inch, is drilled into the side of the ski or mounting plate and the protrusion protrudes approximately ⅛ of an inch from the side of the ski or binding plate. In this manner, the bullet catch is held firmly in place and the protrusion of the bullet catch may be retracted into the shaft of the bullet catch. As described above, the user need only step into the front bracket so that the protrusion retracts and slide his foot backward or forward until the protrusions find the holes in the front bracket and extend, thus locking the ski and the plate together. The front bracket therefore need only extend up as high as the location of the bullet catch. When the bullet catch is applied directly to either side of the ski, for example, the front bracket need only extend as high as the top of the ski. In these embodiments, it is preferred that at least one side of the front bracket be flared and slightly extended so that the user may easily apply pressure to the side of the front bracket to slightly increase the distance between the front bracket and the ski or binding plate so that there is sufficient clearance for the user to be able to step out of the front bracket while the bullet catch is extended. A modified ski pole basket is preferably used for this task. Instead of a traditional full circle pole basket, the preferred pole basket would be a half circle with a rigid inner lip that could be hooked onto the flare of the front bracket.

In an alternative, reversed version of this embodiment including protrusions, it is the front bracket itself that includes the protrusions, rather than the ski or binding plate, as above. The protrusions are preferably hemispherical in shape and lock into notches included on either inner side of the binding plate or ski. The notches are sized and shaped to accept the protrusions. The front bracket has both enough flexibility so that it may expand slightly as the protrusions are being placed into the notches and enough tension so that it is held firmly in place one the protrusions are placed in the notches. At least one side of the top of the binding plate may be slightly flared so that the user may press down on the top with his pole to release the binding. The top of the front bracket may also include a tab or something similar to catch the pole to make this release easier for the user. In an alternative version of this embodiment, the binding plate is eliminated and the protrusions instead lock into notches drilled directly into the side of the ski. In either version of this embodiment, i.e. whether the notches are in a binding plate attached to a ski or in the ski itself, the extension and retraction of the protrusions may be automated. In these versions, the width of the front bracket on either side is as thick or slightly thicker than the depth of the protrusion so that the protrusion may be retracted into the width of the front bracket. As with the automation as described above with reference to the embodiment of the present invention including a riser plate, there are several options for a device for activating the automation of the extension and retraction of the protrusions and the placement of the device. This embodiment may include features as described above, such as fins, a snow diverter, steel edges, or handholds.

The modified ski of the present invention is a prior art ski that has been modified by including protrusions from either side of the ski. The protrusions may be rounded and may be retractable, and are positioned roughly at the front of the boot or ski binding, where a climbing skin plate of the present invention would be attached to the ski. The protrusions are preferably disposed at the front boot binding area of the ski, which is the approximate area around where the front of a boot binding would be disposed on the ski. The protrusions do not protrude a great distance from the sides of the skis, but enough so as to attach an object or device to the ski if that object or device is designed so as to accept the protrusion thereby securing the object or device to the ski. A preferred protrusion is a 4-40 size socket head cap screw. The 4-40 size socket head cap screw has a threaded insert that is inserted into the side of the ski, but is removable with an Allen wrench. Although not retractable, the 4-40 size socket head cap screw preferably protrudes only approximately 1/16", and at no times more than 1/4", so if the object or device being attached to the ski has enough flexibility, it is able to expand enough while applying the object or device to the ski to accept the added width of the 4-40 size socket head cap screw and then flex back into position around the 4-40 size socket head cap screw, securing the object or device to the ski. Moreover, with such a slight protrusion, the protrusion does not get in the skier's way when he is turning in ski mode. Another preferred protrusion is a bullet catch or friction catch as described above. Such a protrusion is retractable. In some embodiments of the modified ski of the present invention, the protrusions are retractable into the ski and extendable out of the ski by automation. A user may therefore retract the protrusions by pushing a button or flipping a switch, for example; align the ski with the object or device to be attached to the ski by aligning where the protrusions are when extended on the ski with the place on the object or device designed to accept the protrusions; and extending the protrusions into the object or device, again by pushing a button or flipping a switch. These are but a few examples of preferred protrusions. One of ordinary skill in the art will recognize that there are a variety of screws, catches, and similar devices that could be successfully substituted as protrusions. Each of these are contemplated as being within the scope of this invention.

In its most basic form, a climbing skin plate kit of the present invention includes at least one pair of protrusions, as described above with reference to the modified ski of the present invention, at least one front bracket designed to accept protrusions, and at least one rigid plate. The climbing skin plate kit preferably includes a pair of front brackets, a pair of rigid plates, and two pairs of protrusions. The front bracket includes two front bracket sides that have holes through them. The protrusions are sized to fit through the holes.

The front brackets are to be applied to the rigid plates so as to enable the rigid plates to be attached to the skis. The preferred embodiment of this climbing skin plate kit includes instructions on applying the front brackets to the rigid plates. The front brackets are preferably two identical pieces to be applied to the rigid plate so that they are mirror images of one another. The front brackets are preferably roughly "L" shaped with a base portion to be attached to the rigid plate, and the front bracket side that extends from the base portion up, so that the top of the front bracket side will rise at least slightly above the ski when the ski is attached to the rigid plate. The angle in the "L" shape of the front bracket is 90° or less, and is preferably approximately 78.5°.

The climbing skin plate kit preferably includes adjustment means for applying the front brackets to the rigid plate so that the distance between the bottom sections of the two front bracket sides is slightly larger than the width of the ski, so as to snugly fit around the ski when the rigid plates are applied to the ski. These adjustment means include any means so that the base portions of the front brackets may be moved closer or farther from each other so that the corresponding front bracket sides may move closer or farther from one another, thus being able to accommodate skis of different widths. The preferred adjustment means include at least one and preferably two parallel, slotted tracks disposed within the base portions of the front brackets perpendicular to the angle of the front brackets, at least one, and preferably two holes disposed through the base portions, and at least two, and preferably four adjustment screws of a size so as to fit into and hold position within the slotted tracks and the holes, where the number of adjustment screws is equal to the sum of the number of tracks and holes in the base portions. The preferred adjustment screw size and type is a 6-32 button head socket screw, although many types of screws or bolts may be used, including those with flat heads, as discussed below.

With this preferred adjustment means, the base portions are arranged so that the front brackets can accept the ski snugly. The adjustment screws are applied through the slots and through the holes so as to secure the front brackets to the rigid plates in that position. With these preferred adjustment means, it is preferred that the kit also include a leveling surface to be placed over the base portions and adjustment screws so as to make the surface level with the tops of the screws. The leveling surface is preferably a piece of rubber that is as thick as the height of the head of the screw and includes cut out slots to accommodate the various positions that the adjustment screws might be within the tracks and holes of the base portions.

In an alternative preferred embodiment, the front brackets are integrated within the height of the rigid plate so that flat headed adjustment screws may be applied so as to be flush with the top of the rigid plate. In other words, there is a pocket within the height of the rigid plates for the base portions of the front brackets so that the front brackets may be moved outward and inward to adjust for ski widths. Once the correct adjustment is made, the adjustment may be screwed down through the top portion of the plate, the pocket containing the front bracket, and the bottom portion of the plate, so that the adjustment screw is flush with the top of the plate. This embodiment does not require a leveling surface and may include only slotted tracks and no holes for adjustment.

In some embodiments of this climbing skin plate kit, the front brackets are non-adjustable and are pre-applied to the rigid plates. In this embodiment, the front brackets are designed and pre-adjusted to fit snugly around the skis of the kit or a ski of a standard width. In this embodiment, the front brackets may not include base portions, but only front bracket sides extending from and integral to the rigid plate. In such embodiments, the rigid plate and front bracket may be one integral piece with the rigid plate significantly thinner than rigid plates of other embodiments described herein. This is because there is no need for the rigid plates to have sufficient depth to accept screws of adjustment means for attaching the front brackets to the rigid plates.

Each front bracket side includes a hole designed to accept a protrusion from the side of a ski. The hole is preferably in the center of the front bracket side's length and positioned within the front bracket side's height so that if a ski were attached to the rigid plate so that its protrusions were protruding through the holes of the front bracket sides, then the bottom side of the ski would rest on the base portions of the front bracket or any leveling surface that may be placed on top of the base portions of the front bracket.

The insides of the front bracket sides include a roughly "V" shaped area of reduced thickness, where the angle of the "V" narrows into the hole. This area of reduced thickness guides the protrusions into the holes of the front bracket sides when a user is transitioning into climb mode. The area of reduced thickness may be formed by the front brackets being made of two pieces except in the area of reduced thickness where one piece is cut away. It is preferred, however, for the front bracket to be one piece that has the area of reduced thickness integral to it. Moreover, in some preferred embodiments, the area of reduced thickness is not different in thickness from the rest of the front bracket, but is defined by cuts along the "V" leading to the hole. In such embodiments, the entire area of reduced thickness flexes in as a ski with protrusions is being applied to the holes of the front bracket and then flexes out again once the ski and protrusions are in place.

The front bracket sides preferably flare out slightly at their tops in the opposite direction from the base portions. The angle of the flare is approximately 130° from the top sections of the front bracket sides below the flares. The flare creates a lip, which may be pressed on by the user, such as with the basket of his ski pole, so as to release the ski from the climbing skin plate. The angle to form the lip occurs just above where the top side of a ski would sit when attached to the climbing skin plate. This means that the distance from the angle of the "L" shape of the front brackets to the angle to form the flare is normally approximately ½".

This climbing skin plate kit preferably includes instructions on modifying a pair of skis with the protrusions, as described above with reference to the modified ski of the present invention. This involves drilling holes in the sides of the skis at the front boot binding area so as to attach the ski to the rigid plates at the site of the holes, and supplying the protrusions into the drilled holes. In some embodiments of this climbing skin plate kit, at least one ski, and preferably a pair of skis, is included in the kit. In some of such embodiments of this climbing skin plate kit, the protrusions are pre-applied to the skis.

Some embodiments of the climbing skin plate kit include rear brackets. The rear brackets are similar to the front brackets in almost all respects. They differ in that they do not include a hole or an area of reduced thickness. In addition, they are positioned at the rear area of the rigid plate so as to be under the user's heel area, as opposed to under the user's toe area or in front of the user's boot, as with the front brackets.

The front brackets, and rear brackets when included, of the climbing skin plate kit are preferably made of stainless steel, plastic, or any other material that is stiff enough to hold the skis in place during climbing mode, but that also has enough flexibility so as to allow the skis to move in and out of the front bracket when changing between ski mode and climb mode and vice versa. When the front brackets are made of stainless steel, the front bracket sides may be made of two pieces of stainless steel that are attached to each other, preferably by riveting or spot welding. The two pieces are commensurate except that the inner piece has the "V" shaped area cut out of it so that when the two pieces are attached to one another, this cut out creates the area of reduced thickness. In some embodiments, the front brackets, including the front bracket sides, are made of a single piece that has the inner "V" shaped area of reduced thickness. In some embodiments, the combination of a rigid plate and a front bracket are made of a single integrated piece.

This climbing skin plate kit may include many of the attributes discussed above with reference to other embodiments of the present invention. The rigid plates may include diverter springs and/or snow adhering substance and/or one or more fins, and may be sectioned into two or more sections. The diverter spring may be merely an angle cut into the front of the rigid plate. When the rigid plates are in two or more sections, the foldable connecting device between the sections is preferably a pinless plastic hinge, such as though sold under the trademark, HARSH ENVIRONMENT. The kit may also include crampon attachments. The foldable connecting device may also be a piece of plastic that is affixed on either end to one of the rigid plate sections and is scored and folds easily along the space between the rigid plate sections without breaking.

In its most basic form, a climbing skin plate kit of the present invention includes climbing skin plates, skis with ski boot binding, and a plate holder.

The climbing skin plates may be any of the embodiments described above. The binding system of the climbing skin is preferably permanently mounted on the skis for use with the plates. When the plates are sectioned, the preferred plate holder is a shin bag that holds the plates against the user's boot while skiing. Such a shin bag is unnoticeable while the user is skiing. The shin bag includes a pouch in which the plates rest, and clip that may be attached near the knee. The shin bag may include snaps of hook and loop type fastener to secure the bag to the shin and avoid rotation during skiing. Other plate holders may be bags or straps for holding the plates across the user's chest or back while the user is skiing. Such embodiments may be preferable for plates that are not sectioned, and are thus longer, so could not be attached to the user's shin without hampering the user's movement during ski mode. One such plate holder for wearing the climbing skin plates across the user's chest may include two pouches, at least the bottom of which is stretchy, so that a user may push the climbing skin plates up into the upper pouch and then stretch the bottom pouch around the bottom of the climbing skin plates. Another plate holder may be a pouch that clips to the user's ski pole while the user is skiing. All plate holders may include areas for extra storage.

In some embodiments, the climbing skin plate kit of the present invention may include removable crampons as described above, snow adhering substances that may be attached to the bottom side of the plates, locking devices for sectioned plates, removable fin features, and/or handheld devices for controlling automated features.

The climbing skin plates of the present invention have many uses, beyond backcountry skiing as originally contemplated by the inventor. They may be used to mount to an alpine touring set up or a telemark ski. The ease and speed of applying and removing the plates of the present invention would make small mountain randonee events possible. In ski areas, ski coaches and gate keepers, as well as other ski area employees, spend much of their time climbing up and skiing down the mountain. Using the plates of the present invention, these employees could keep their skis on at all times during the climbing and skiing. Moreover, terrain park skiers often choose to hike up a mountain to a jump, rather than ski to the bottom to take the lift. The hiking would be much easier with the plates of the present invention, as opposed to the hiker taking off his skis and hiking up in ski boots while holding his skis. Finally, beginner skiers who may be wary of gaining too much speed, may apply climbing skin plates even during ski mode so that their speed is curtailed.

Therefore it is an aspect of the present invention to provide climbing skins that may be applied to a ski without removing the ski.

It is a further aspect of the present invention to provide a device for applying climbing skins without the necessity of glue.

It is a further aspect of the present invention to provide removably attachable climbing skin plates for attaching to skis.

It is a further aspect of the present invention to provide finned climbing skin plates attachable to the bottom of a ski for additional traction during climbing.

It is a further aspect of the present invention that the climbing skin plates may be foldable for compactness.

It is a further aspect of the present invention to provide a climbing skin plate that may be easily stepped into by the user while the user is in his skis.

It is a further aspect of the present invention to provide several binding systems for binding the climbing skin plate to the ski.

It is a further aspect of the present invention to provide a climbing skin plate with a spring diverter to avoid snow build up between the ski and climbing skin plate.

It is a further aspect of the present invention to provide a climbing skin plate that is adjustable to the user's preference and the user's ski.

It is a further aspect of the present invention to provide a climbing skin plate that includes a riser plate that attaches the climbing skin plate to the ski directly beneath the user's foot.

It is a further aspect of the present invention to provide a climbing skin plate that attaches to the ski by bullet catches included on the sides of either the ski or a binding plate attached to the ski.

It is a further aspect of the present invention to provide a climbing skin plate that attaches to the ski through notches in the ski itself.

It is a further aspect of the present invention to provide a climbing skin plate kit including climbing skin plates, skis with binding systems capable of binding the climbing skin plates to the skis, and a holder for the climbing skin plates.

These aspects of the present invention are not meant to be exclusive and other features, aspects, and advantages of the present invention will be readily apparent to those of ordinary skill in the art when read in conjunction with the following description and accompanying drawings.

DETAILED DESCRIPTION

Figure 1:
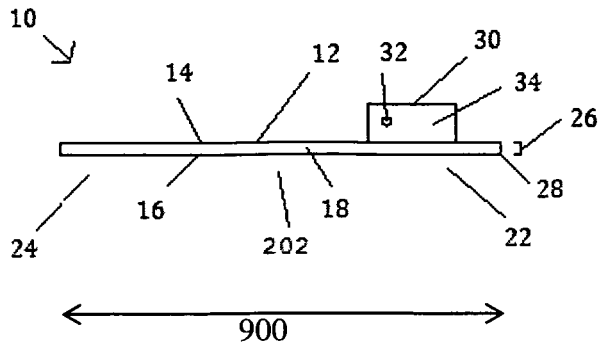
FIG. 1 is a side view of a climbing skin plate of the present invention.

Referring first to FIGS. 1-4, side views of several different embodiments of the present invention are shown. FIG.1 shows a basic climbing skin plate 10 of the present invention, including rigid plate 12 and front bracket 30. Rigid plate 12 includes top side 14, bottom side 16, right side 18, left side 20 (not shown), front area 22, center area 202, rear area 24, height 26, bottom front edge 28, and length 900. Front bracket 30 includes pin hole 32 and front bracket side 34.

Figure 2A:
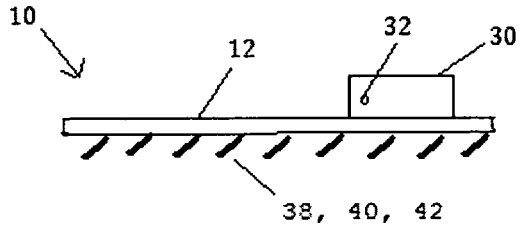
FIG. 2A is a side view of a climbing skin plate of the present invention with a finned rigid plate with the fins running across the width of the rigid plate.
Figure 2B:
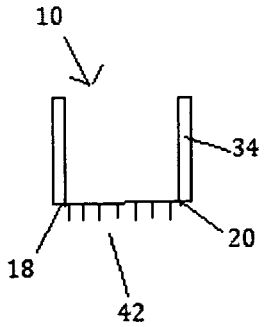
FIG. 2B is a front view of a climbing skin plate of the present invention with a finned rigid plate with the fins running down the length of the rigid plate.
Figure 2C:
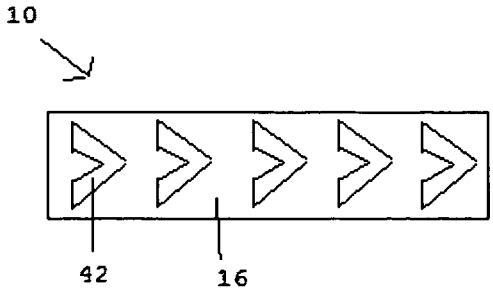
FIG. 2C is a bottom up view of a climbing skin plate of the present invention with wishbone shaped fins running across the width of the rigid plate.

FIGS. 2A-2C show climbing skin plates 10 where bottom side 16 of rigid plate 12 includes fins 42. FIG. 2A shows fins 42 running across bottom side 16 of rigid plate 12 from right side 18 to left side 20. As is preferred, fins 42 are angled at about 45° from bottom side 16 of rigid plate 12. FIG. 2A shows fins 42 emboldened to indicate that they are covered on at least one side with snow adhering substance 38, which is preferably mohair 42. It is understood, however, that in some embodiments, fins 42 are not covered with snow adhering substance 38/mohair 40. FIG. 2B shows fins 42 running down the length of bottom side 16 of rigid plate 12 from front area 22 to rear area 24. FIG. 2C shows fins 42 in a wishbone shape. Although not apparent from the bottom up view of FIG. 2C, wishbone shaped fins 42 as shown in FIG. 2C are also angled from the bottom side 16, as shown in FIG. 2A.

Figure 3A:
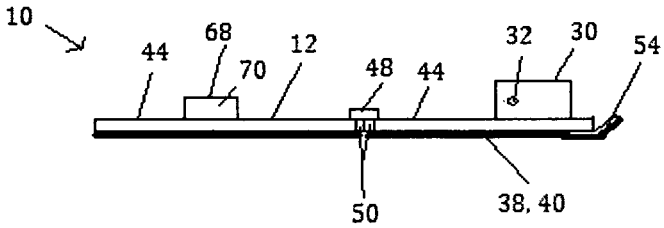
FIG. 3A is a side view of a climbing skin plate of the present invention with a rigid plate in two sections.
Figure 3B:
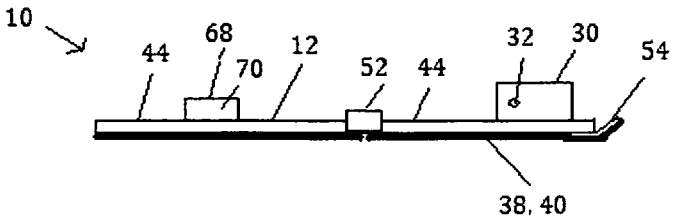
FIG. 3B is a side view of a climbing skin plate of the present invention with a rigid plate in two sections and a removable locking device.

FIGS. 3A and 3B show climbing skin plate 10 where rigid plate 12 is in two sections 44. When rigid plate 12 is in more than one section, a foldable connecting device 48, preferably a hinge, is included between sections 44. Rubber stops 50 may be included at the ends of sections 44, proximate to foldable connecting device 48 so that rubber stops 50 alleviate some of the pressure applied to foldable connecting device 48 when sections 44 are opened. In some embodiments where rigid plate 12 is in sections 44, removable locking device 52 is included to lock rigid plate 12 open, as shown in FIG. 3B. Removable locking device 52 is placed over foldable connecting device 48 and rubber stops 50. FIGS. 3A and 3B also show snow adhering substance 38/mohair 40 applied to a non-finned rigid plate 12; diverter spring 54; and rear bracket 68 with rear bracket side 70.

Figure 4:
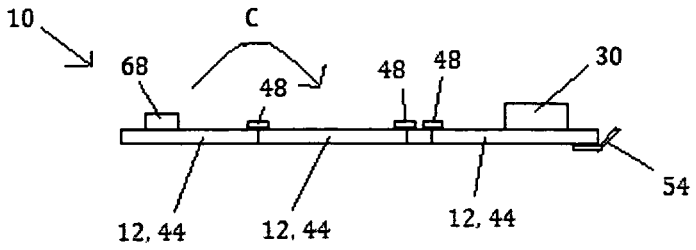
FIG. 4 is a side view of a climbing skin plate of the present invention with a rigid plate in three sections.

FIG. 4 shows climbing skin plate 10 where rigid plate 12 is in three sections 44. It is preferable that when climbing skin plate 10 is folded up, the last section 44 is folded up first in the direction of arrow C.

Figure 5A:
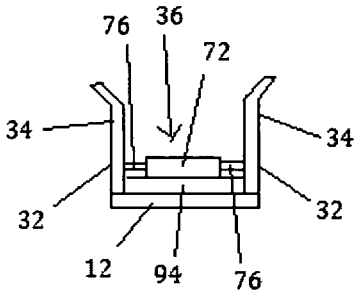
FIG. 5A is a front view of a climbing skin plate of the present invention applied to a ski, without a diverter spring.
Figure 5B:
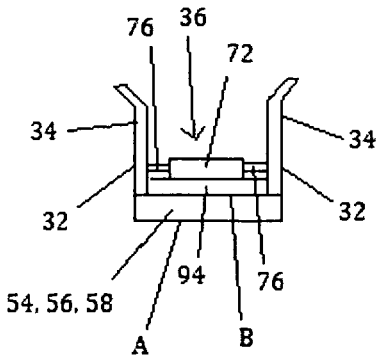
FIG. 5B is a front view of a climbing skin plate of the present invention applied to a ski, with a diverter spring.

Now referring to FIGS. 5A and 5B, a front view of climbing skin plate 10 is shown applied to a ski 94, without and with diverter spring 54, respectively. FIGS. 5A and 5B show both front bracket sides 34 of front bracket 30, as well as binding system 36, including binding plate 72 and pins 76. In FIG. 5A, we see a cross section of ski 94 bound between rigid plate 12 and binding plate 72. Binding plate 72 is preferably affixed to ski 94, as discussed below with reference to FIGS. 7A and 7B. When in climb mode, i.e. when climbing skin plate 10 is applied to ski 94, pins 76 extend through pin holes 32 of front bracket 30. As front bracket 30 is affixed to rigid plate 12 and binding system 36 is affixed to ski 94, when binding system 36 engages with front bracket 30 through pins 76, rigid plate 12 and ski 94 are also affixed, but removably so. FIG. 5B shows climbing skin plate 10, as in FIG. 5A, but including diverter spring 54. Comparing FIGS. 5A and 5B, it is clear that diverter spring 54 covers height 26 of rigid plate 12 (see FIG. 1), extending from bottom front edge 28 of rigid plate 12 to the bottom of ski 94. Although not clear from this view, diverter spring 54 covers height 26 diagonally (see FIGS. 3A, 3B, and 4, for example). Thus, line A is farther away from the viewer than line B. This view also shows diverter spring bottom side 56, which is preferably covered with snow adhering substance 38/mohair 40. This view also shows that diverter spring 54 has a preferably rectangular shape 58.

Figure 6:
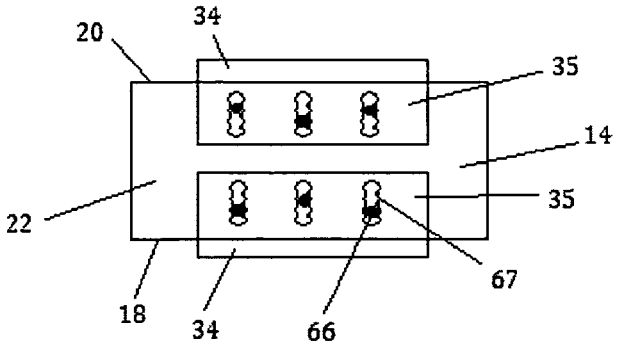
FIG. 6 is a top down view of a preferred attachment of a front bracket to a rigid plate.

Now referring to FIG. 6, a preferred method of attaching front bracket 30 to rigid plate 12 is shown. In this view, we see top side 14 of rigid plate 12, with right and left sides 18, 20. Front bracket 30 is preferably attached to front area 22 of rigid plate 12. In addition to front bracket sides 34, it is preferably that front bracket 30 include attachment flanges 35. Attachment flanges 35 include countersunk bolts 66 in slotted tracks 67. Countersunk bolts 66 and slotted tracks 67 allow front bracket 30 to be adjusted for width of ski and other factors. Although all tracks are shown as slotted tracks 67 in FIG. 6, in some embodiments, only one track per attachment flange 35 is slotted.

Figure 7A:
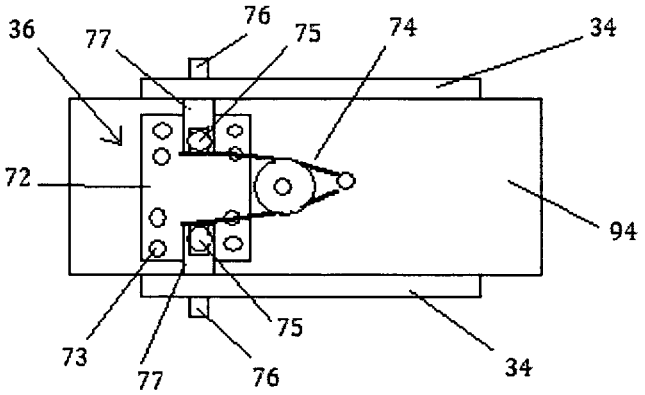
FIG. 7A is a top down view of a preferred embodiment of a binding system during climb mode.
Figure 7B:
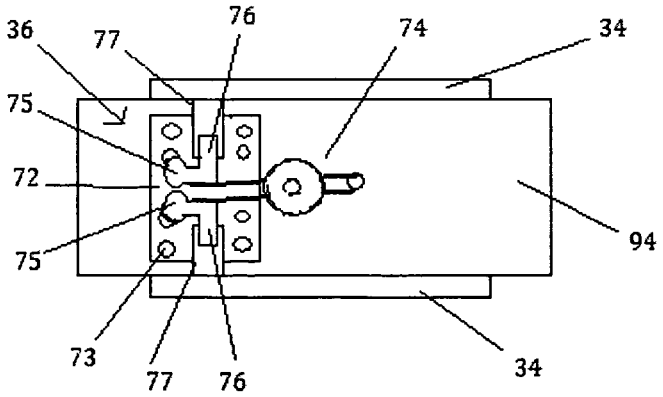
FIG. 7B is a top down view of a preferred embodiment of a binding system returning to ski mode.

Now referring to FIGS. 7A and 7B, a binding system 36 is shown. Binding system 36 includes binding plate 72, binding plate bolts 73, spring mechanism 74, pins 76, pin sleeves 77, and pin arms 75. Binding plate 72 is affixed to the top side of ski 94 by binding plate bolts 73. Pins 76 move through pin sleeves 77. This motion is controlled by moving pin arms 75 so that spring mechanism 74 is compressed or released. In this embodiment, spring mechanism 74 includes a pin type spring, as shown. In FIG. 7A, pin arms 75 are rotated upward and moved into a notch in pin sleeves 77. This releases spring mechanism 74 and allowing pins 76 to move farther into pin sleeves 77, which further allows pins 76 to move through pin holes 32 in front bracket 30, and bind ski 94 to rigid plate 12. The depiction in FIG. 7A with pins 76 sticking that far out through front bracket sides 34 is an exaggeration for clarity to clearly show that pins 76 extend through pin holes 32 in front bracket sides 34. In reality, although pins 76 do extend through pin holes 32, they do not do so to such an extent. In FIG. 7B, pin arms 75 are squeezed together and rotated down to catch on the side of pin sleeves 77. This compresses spring mechanism 74, retracting pins 76 from pin holes 32, so that the user may step out of front bracket 30 for ski mode. The spring mechanism 74 configuration depicted in FIGS. 7A and 7B is but one of many configurations contemplated as being encompassed by the present invention. FIGS. 7A and 7B depict a wish-bone style spring but a compression-type spring extending between the two pins or two compression-type springs between the pins, one for each pin may be substituted for the wish-bone style spring depicted, for example.

Figure 8A:
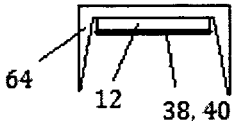
FIG. 8A is a side view of a crampon attachment applied to a rigid plate.
Figure 8B:
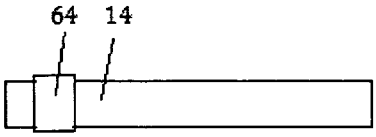
FIG. 8B is a top down view of a crampon attachment applied to a rigid plate.

Now referring to FIGS. 8A and 8B, a crampon attachment 64 is shown. In some embodiments of the present invention, removable crampon attachments 64 may be applied to rigid plate 12. FIG. 8A shows a cross section of crampon attachment 64 applied on top of rigid plate 12. Crampon attachments 64 are preferably made of steel and shaped like fins. FIG. 8B shows the top of crampon attachment 64 spanning the width of top side 14 of rigid plate 12.

Figure 9:
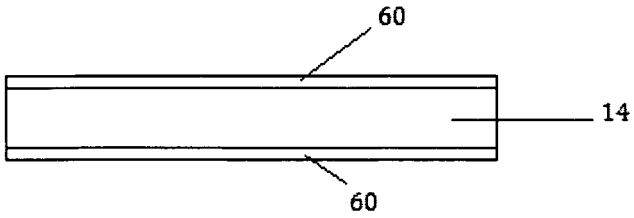
FIG. 9 is a top down view of a climbing skin plate of the present invention with steel edges.
Figure 10:
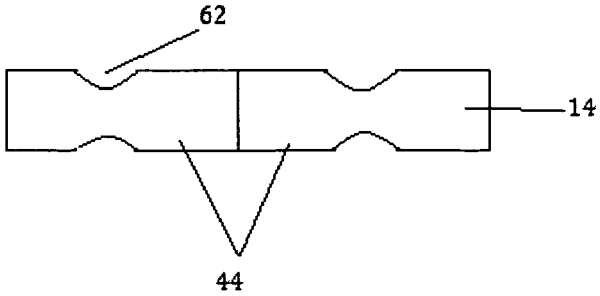
FIG. 10 is a top down view of a climbing skin plate of the present invention with handholds.

Now referring to FIG. 9, top side 14 of rigid plate 12 is shown with steel edges 60. Now referring to FIG. 10, top side 14 of rigid plate 12 is shown where rigid plate 12 includes handholds 62. Although only depicted in one embodiment each, it is understood that steel edges 60 may be applied to rigid plates 12 with sections 44 and handholds 62 may be used on rigid plates 12 that do not include sections 44.

Figure 11:
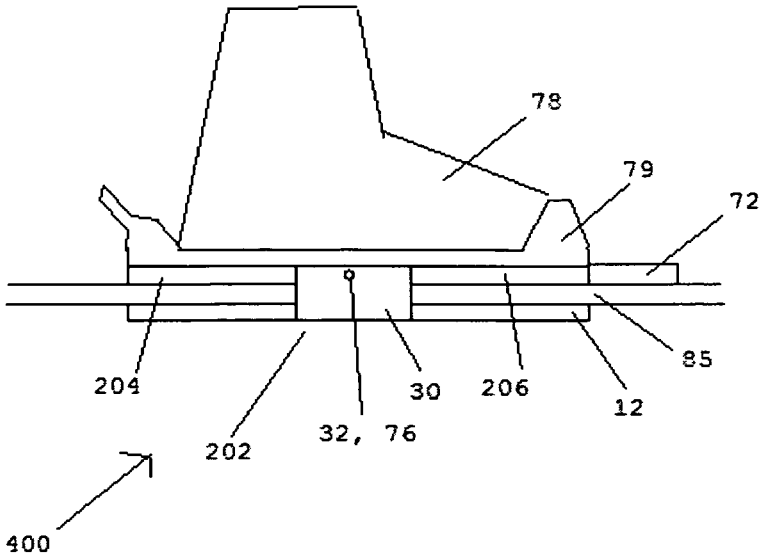
FIG. 11 is a side view of a climbing skin plate of the present invention including a riser plate in combination with a ski, boot binding, and ski boot.
Figure 12A:
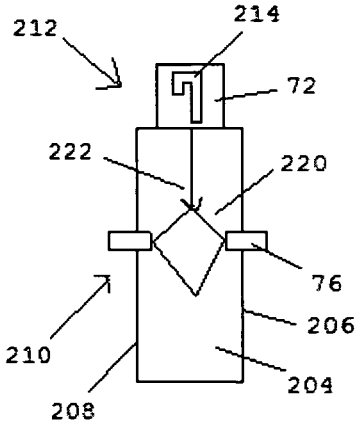
FIG. 12A is a diagram of a manual embodiment of the pin moving device and pin moving device operator of a climbing skin plate of the present invention.
Figure 12B:
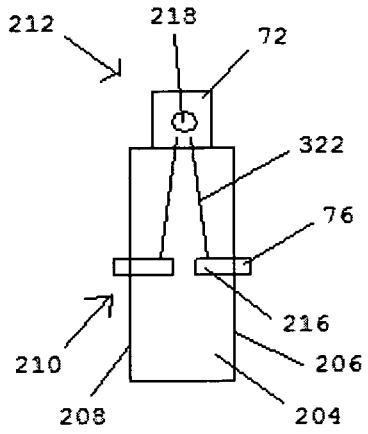
FIG. 12B is a diagram of an automated embodiment of the pin moving device and pin moving device operator of a climbing skin plate of the present invention.

Now referring to FIGS. 11, 12A, and 12B, climbing skin plate 400 of the present invention, including riser plate 204 is shown. FIG. 11 is a side view of climbing skin plate 400 in use. Riser plate 204 is mounted between ski 85 and boot binding 79. Ski 85 is held firmly between climbing skin plate 12 and riser plate 204. Front bracket 30 is positioned not in the front area 22, but in center area 202. This allows climbing skin plate 12 and snow adhering substance 38 on the bottom side 16 of rigid plate 12 to be held most closely to the user's foot directly under the user's foot, where the user needs traction the most. Although not shown in FIGS. 11, 12A, and 12B, it is understood that rigid plates 12 of climbing skin plate 400 may include other features disclosed above, such as any of fins 42 shown in FIGS. 2A-2C, snow deflector plate 54 shown in FIGS. 4 and 5B, and/or crampon attachment 64 shown in FIGS. 8A and 8B.

In this embodiment, a pin moving device 210 is housed within the riser plate 204. A pin moving device operator 212 is in communication with pin moving device 210 and is somewhere exterior of riser plate 204. Pins 76 are extendable and retractable from right 206 and left 208 sides of riser plate 204. This extension and retraction may be manual or automated.

FIG. 12A is a diagram showing the pin moving device 210 and pin moving device operator 212 of a configuration for manual extension and retraction of pins 76. In this embodiment, pin moving device 210 is spring mechanism 220 and pin moving device operator 212 is locking mechanism 214. Spring mechanism 220 is housed within riser plate 204 between pins 76 so that when spring mechanism 220 is relaxed, pins 76 extend out of riser plate 204 and when spring mechanism 220 is contracted, pins 76 retract into riser plate 204. When getting into climb mode, the user will apply climbing skin plate 400 as described above with reference to other embodiments. He will simply step into front bracket 30 and move his foot back until pins 76 mate with pin holes 32 so that spring mechanism 220 may relax. As pins 76 are not in front of the user's boot in this embodiment, however, another element must be included for retracting pins 76 to switch into ski mode. Closed loop 222 is also housed primarily within riser plate 204 and consists of wires connecting spring mechanism 220 with locking mechanism 214 on the exterior of riser plate 204. In climb mode, locking mechanism 214 is positioned so that the wires in closed loop 222 have slack so that spring mechanism 220 may remain relaxed. To switch to ski mode, locking mechanism 214 may be positioned so that it pulls on the wires in closed loop 222, thus contracting spring mechanism 220 and retracting pins 76. Locking mechanism 214 is mounted on binding plate 72, which is affixed to ski 85 as described above with reference to other embodiments of the present invention. As shown, the user need only reach down in front of his boot to manipulate locking mechanism 214 to switch into ski mode. The configuration shown in FIG. 12A is just one configuration for manual extension and retraction of pins 76. One of ordinary skill in the art will recognize that there are several ways in which such manual extension and retraction may be achieved and each of these is contemplated as being within the scope of the present invention.

FIG. 12B is a diagram showing the pin moving device 210 and pin moving device operator 212 of a configuration for automated extension and retraction. In this embodiment, pin moving device 210 is actuators 216 and pin moving device operator 212 is switch 218. In the automated version shown in FIG. 12B, electronic connectors 322 are physically housed primarily in riser plate 204 and connect actuators 216 with switch 218, which is exterior of riser plate 204 and mounted on binding plate 72. The user need only flip switch 218 to move actuators 216 out or in to extend or retract pins 76. In this automated version, pins 76 will not simply catch pin holes 32, however. The user must align pins 76 on riser plate 204 with pin holes 32 on front bracket 30 before extending pins 76 with switch 218. This alignment may be aided by visual effects, such as coordinating stripes on front bracket 30 and riser plate 204 to let the user know when they are aligned. FIG. 12B shows actuators 216 and switch 218 as being physically wired. In some embodiments, however, there is a wireless connection between the two. In such embodiments, binding plate 72 may be eliminated and switch 218 may be included on a handheld device that may be placed on the user's person according to the user's preference.

Now referring to FIGS. 13A, 13B, 14, 15A, and 15B, climbing skin plate kit 500 of the present invention is shown. Climbing skin plate kit 500 includes ski 85, rigid plate 12, front bracket 30, and protrusions 504. Rigid plate 12 and front bracket 30 are as described above with reference to other embodiments of the present invention. Front bracket 30 may be positioned in front area 22 of rigid plate 12 or center area 202 of rigid plate 12, similar to climbing skin plate 400. Although not shown in FIGS. 13A, 13B, 15A, and 15B, it is understood that rigid plates 12 of climbing skin plate kit 500 may include other features disclosed above, such as any of fins 42 shown in FIGS. 2A-2C, snow deflector plate 54 shown in FIGS. 4 and 5B, and/or crampon attachment 64 shown in FIGS. 8A and 8B.

Figure 13A:
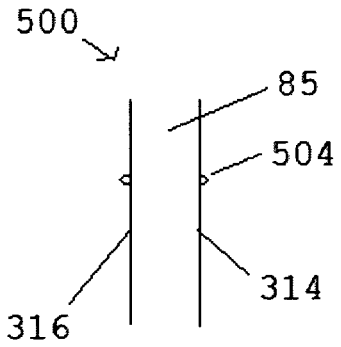
FIG. 13A is a top down view of a ski of a climbing skin plate kit of the present invention.
Figure 13B:
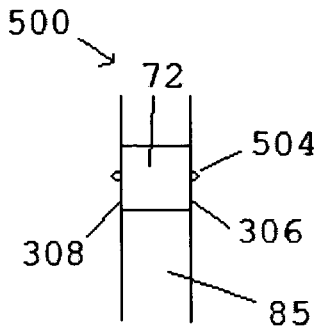
FIG. 13B is a top down view of a ski of an alternative climbing skin plate kit of the present invention.

In climbing skin plate kit 500, protrusions 504 mate with pin holes 32 of front bracket 30. Protrusions 504 may protrude directly from right and left sides 314, 316 of ski 85, as shown in FIG. 13A, or right and left sides 306, 308 of binding plate 72, which is mounted on ski 85, as shown in FIG. 13B.

Protrusions 504 are preferably retractable and may mate with pin holes 32 of front bracket 30 as described above. To enter climb mode, the user steps into front bracket 30 and moves his foot forward or backward until protrusions 504 mate with and lock into pin holes 32. When protrusions 504 protrude directly from right and left sides 314, 216 of ski 85, front bracket 30 may be mounted either in front area 22 or center area 202 of rigid plate 12. It is preferred that front bracket be mounted in center area 202 so that rigid plate 12 with its grip aiding properties is held most closely to ski 85 directly under the user's foot.

Figure 14:
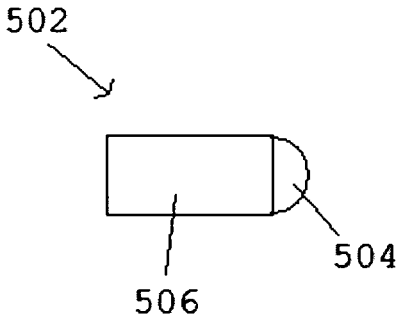
FIG. 14 is a blown up side view of a bullet catch, the preferred protrusion, of a climbing skin plate kit of the present invention.

Preferred protrusion 504 is part of bullet catch 502, as shown in FIG. 14. Bullet catch 502 includes protrusion 504 and shaft 506. Shaft 506 is drilled into right and left sides 314, 316 or 306, 308 so that bullet catch 502 is held firmly in place in ski 85 or mounting plate 72, respectively. The total length of preferred bullet catch 502 is preferably 7/16 of an inch, with a diameter of approximately 1/4 of an inch. Shaft 506 is approximately 5/16 of an inch and protrusion 504 protrudes approximately 1/8 of an inch from right and left sides 314, 316 or 306, 308.

Figure 15A:
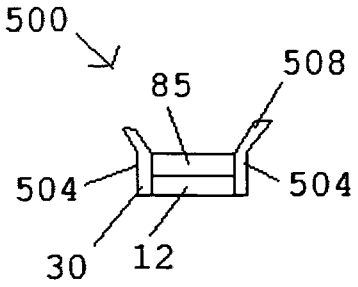
FIG. 15A is a cross sectional view of a climbing skin plate kit of the present invention.
Figure 15B:
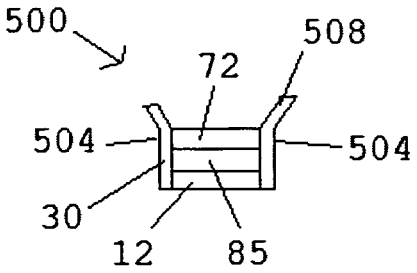
FIG. 15B is a cross sectional view of an alternative climbing skin plate kit of the present invention.

FIGS. 15A and 15B show climbing skin plate kit 500 with protrusions 504 from ski 85 and mounting plate 72, respectively. Although protrusions 504 are not visible in the depictions of FIGS. 15A and 15B as they are within the width of front bracket sides 34, their location is indicated. Moreover, although front bracket sides 34 are shown as having sufficient width to swallow protrusions 504, it is understood that front bracket sides 34 may be only a thin piece of metal, such as aluminum, so that protrusions 504 would be visible coming through front bracket sides 34. It is preferable that protrusions 504 protrude no farther than the widest part of the user's boot so that there is no danger of protrusion 504 being retracted when the user turns.

Front bracket 30 is shown with flares 508 on either front bracket side 34. Flares 508 function as a place for a user to apply pressure with his ski pole so that front bracket sides 34 may be spread slightly in order for the user to step out of front bracket 30 even with protrusions 504 extended, so that user may switch from climb mode to ski mode. In the preferred embodiment, front bracket 30 need only distend approximately 1/16 of an inch. It is preferable that flare 508 be larger on the side of front bracket 30 that will be on the outside of the user's boot, i.e. the hip side of the user's body. This is so that the user may easily access flare 508 with his pole. If only one front bracket side 34 includes flare 508, it is preferable that it be the outside (i.e. hip) side. Flare 508 may include indentations or other catches to aid the user in placing his pole or pole basket on flare 508 so that pressure may be applied without the pole or pole basket slipping. A modified ski pole basket is preferably used for this task. Instead of a traditional full circle pole basket, the preferred pole basket would be a half circle with a rigid inner lip that could be hooked onto the flare of the front bracket. When comparing FIGS. 15A and 15B, it is apparent that when protrusions 504 are from mounting block 72 (as in FIG. 15B), as opposed to directly from ski 85 (as in FIG. 15A), the sides of front bracket 30 must be slightly longer to account for the added depth of mounting block 72 before flare 508 may occur.

Figure 16:
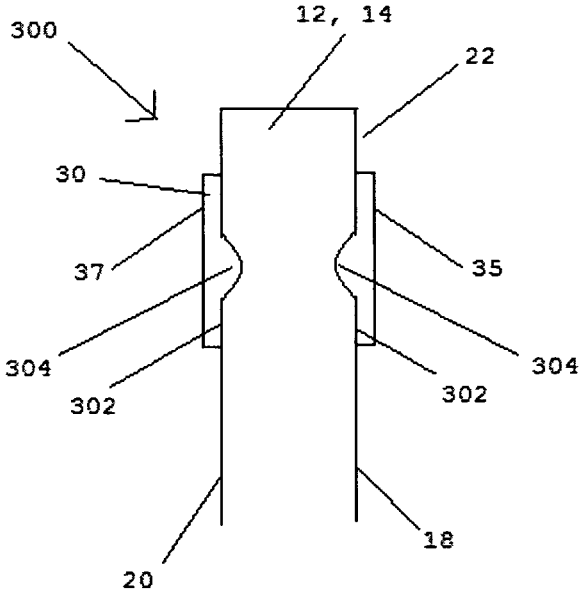
FIG. 16 is a top down view of a climbing skin plate kit of the present invention.
Figure 17A:
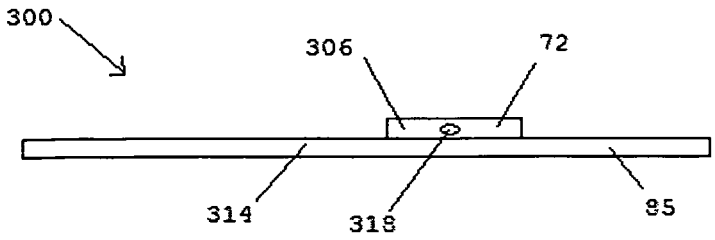
FIG. 17A is a side view of one embodiment of elements of a climbing skin plate kit of the present invention.
Figure 17B:
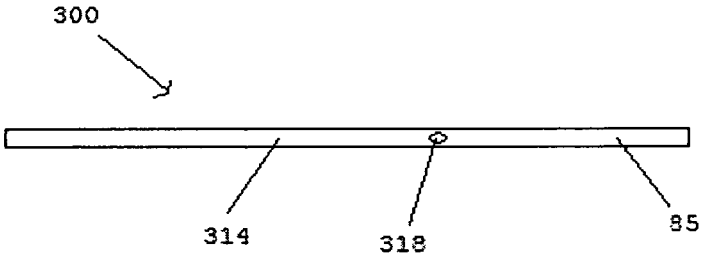
FIG. 17B is a side view of another embodiment of elements of a climbing skin plate kit of the present invention.

Now referring to FIGS. 16, 17A, and 17B, climbing skin plate kit 300 of the present invention is shown. FIG. 16 is a top down view of top side 14 of rigid plate 12. This view shows front bracket 30 with right front bracket side 35 and left front bracket side 37 on the right side 18 and left side 20 of rigid plate 12, respectively. Front bracket 30 is positioned on the front area 22 of rigid plate 12 and has inner sides 302 out of which protrude protrusions 304.

Although not shown in FIGS. 16, 17A, and 17B, it is understood that rigid plates 12 of climbing skin plate kit 300 may include other features disclosed above, such as any of fins 42 shown in FIGS. 2A-2C, snow deflector plate 54 shown in FIGS. 4 and 5B, and/or crampon attachment 64 shown in FIGS. 8A and 8B.

FIG. 17A is a side view of ski 85 with binding plate 72. Although only right side 306 of binding plate 72 and right side 314 of ski 85 are shown, it is understood that binding plate 72 and ski 85 also have left sides. Right side 306 of binding plate 72 includes right notch 310 and left notch (not shown). Right notch 310 and left notch are sized and dimensioned to mate with protrusions 304. FIG. 17B shows an alternative embodiment of climbing skin plate kit 300 that does not include binding plate 72 and right notch 318 and left notch are drilled directly into the right side 314 and left side of ski 85, respectively. In this embodiment, front bracket 30 may also be positioned in center area 202 of rigid plate 12. As with other embodiments of the climbing skin plates 10 of the present invention, to get into climb mode with climbing skin plate kit 300, the user, wearing ski 85, need only step onto rigid plate 12, using front bracket 30 as a guide and slide his foot back until the protrusions 304 of the front bracket 30 mate with and lock into the right notch 318 and left notch of either binding plate 72 or ski 85. To get back into ski mode, front bracket 30 may be flared and include a tab that the user may press with his finger or the end of his ski pole to widen front bracket 30 enough so that at least one protrusion 304 is disengaged from a notch and the user may step out of front bracket 30.

In alternative automated embodiment of climbing skin plate kit 300, the retraction or extension of protrusions 304 is automated. In this embodiment, right and left front bracket sides 35, 37 are thick enough that protrusions 304 may retract into the width of the sides 35, 37. This retraction or extension may be by actuators or other commonly used devices for such mechanical movement. The retraction and extension is controlled by a device with some sort of switch that goes between extension and retraction. The device may be integral to front bracket 30 or ski 85, but may also be a handheld device or other small device that may be held by the user, kept in the user's pocket, or attached to the user's person within easy reach. In this automated embodiment, the top of right and left front bracket sides 35, 37 and the top of binding plate 72 or ski 85 (when climbing skin plate kit 300 does not include binding plate 72) may include corresponding markings indicating the location of protrusions 304 on right and left front bracket sides 35, 37 and the location of right 318 and left notches on binding plate 72 or ski 85. To get into climb mode, the user would step into front bracket 30 with the device switched to having the protrusions 304 retracted into right and left front bracket sides 35, 37. He would then move his foot until the indications on right and left front bracket sides 35, 37 and binding plate 72 or ski 85 aligned and then switch the device to extend the protrusions 304 into the right 318 and left notches. To switch back to ski mode, the user would flip the switch to retract the protrusions 304 and step out of the front bracket. Although the device is described as having a switch, it is understood that the switch could be a button or other art recognized means for alternating between two states or positions.

Figure 18:
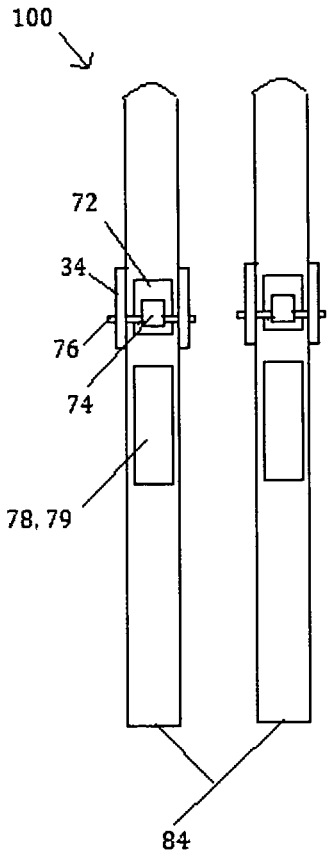
FIG. 18 is a top down view of a pair of climbing skin plates applied to a pair of skis, as included in the climbing skin plate kit of the present invention.
Figure 19:
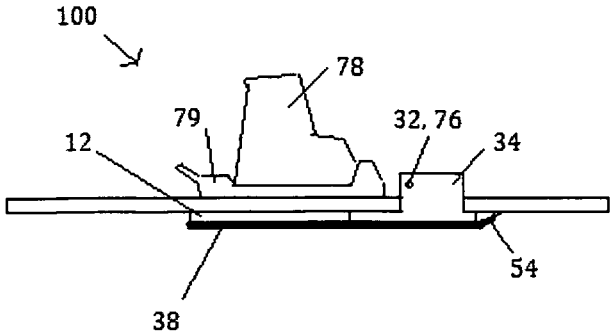
FIG. 19 is a side view of a climbing skin plate applied to a ski, as included in the climbing skin plate kit of the present invention.
Figure 20A:
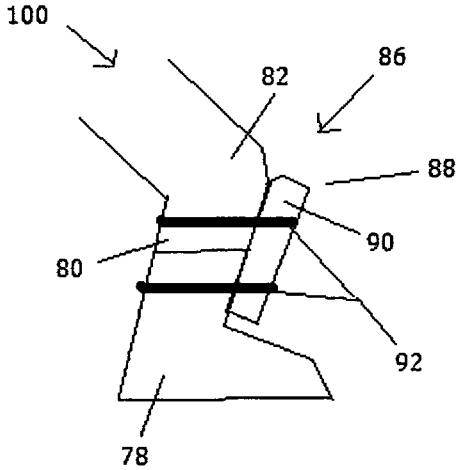
FIG. 20A is a side view of a shin bag plate holder of the climbing skin plate kit of the present invention.
Figure 20B:
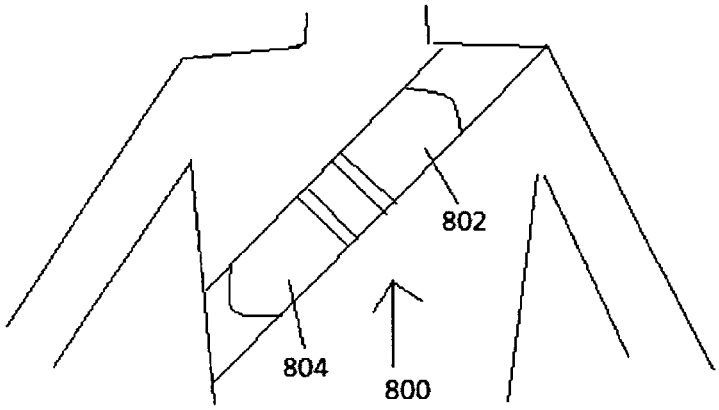
FIG. 20B is a view of a chest bag plate holder of the climbing skin plate kit of the present invention.

Now referring to FIGS. 18-20B, aspects of climbing skin plate kit 100 of the present invention are shown. Climbing skin plate kit 100 includes a pair of climbing skin plates 10, a pair of skis 84, and a plate holder 86. Climbing skin plates 10 include at least rigid plate 12 with snow adhering substance 38, front bracket 30, and binding system 36 or pin moving device 210 and pin moving device operator 212, as described above. FIGS. 18 and 19 are side and top down views, respectively, of climbing skin plates 10 attached to skis 84, as described above. FIGS. 18 and 16 also show the relative position of elements of climbing skin plates 10 with respect to ski boot 78 and boot binding 79. FIG. 20A shows a preferred embodiment of plate holder 86, which is a shin bag 88. Shin bag 88 includes pouch 90 sized and dimensioned to hold at least climbing skin plates 10 in a folded position. Shin bag 88 also includes fasteners 92 for holding pouch 90 in place while the user is skiing. Fasteners 92 are preferably placed below knee 82 and across calf 80. FIG. 20B shows another preferred embodiment of plate holder 86, which is chest bag 800 shown secured to a user's chest. Chest bag 800 has top pouch 802 and bottom pouch 804. At least bottom pouch 804 is stretchy, the idea being that the user pushes one end of rigid plates 12 up into top pouch 804, and then stretches bottom pouch 804 around the other end of rigid plates 12. Although chest bag 800 is shown as being secured to the user diagonally across the user's chest, one of ordinary skill in the art will recognize that there are several ways in which chest bag 800 may be secured to the user's chest.

Referring now to FIGS. 21A-22B, modified ski 600 of the present invention is shown. Modified ski 600 has top side 602, bottom side 604, right side 314, left side 316, bottom side width 606 and front boot binding area 608. Protrusions 504 protrude from right side 314 and left side 316 at front boot binding are 608. Front boot binding area 608 is the general area where the front of a boot binding will occur on a ski. Front boot binding area 608 will vary depending on the type of boot binding, boot, and ski, which is why front boot binding area 608 is depicted as a range. One of ordinary skill in the art will comprehend the average range that such an area may encompass, which is what is contemplated as being front boot binding area 608. Protrusions 504 are preferably socket head cap screw 610, as shown in top down and side views in FIGS. 22A and 22B. The preferred size of socket head cap screw 610 is 4-40 with a length of ⅜". It is understood that socket head cap screw 610 is threaded, even if this is not shown in FIG. 22B. Socket head cap screw 610 protrudes approximately 1/16", and never more than ¼". Another preferred protrusion 504 is bullet catch 502, as shown in FIG. 14. Bullet catch 502 is retractable, as discussed above.

Figure 21A:
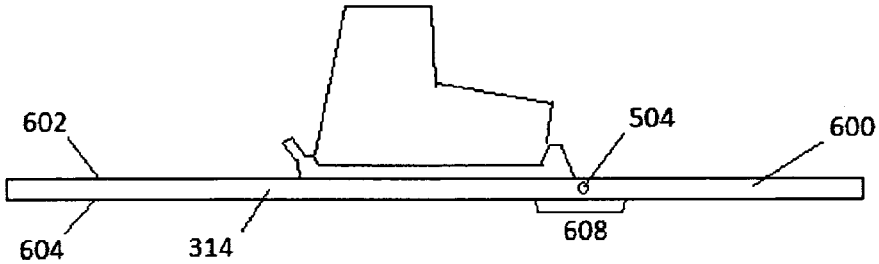
FIG. 21A is a side view of the modified ski of the present invention with a boot binding and boot attached.
Figure 21B:
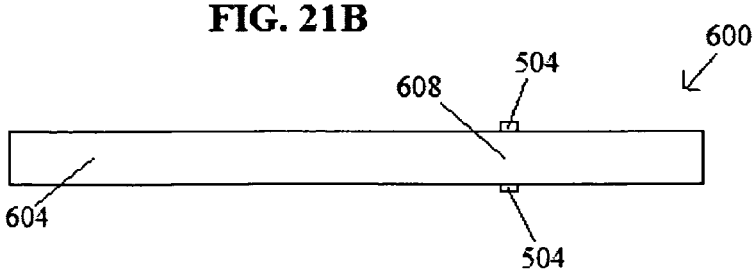
FIG. 21B is a bottom up view of the modified ski of the present invention.
Figure 22A:
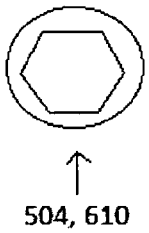
FIG. 22A is a top down view of the preferred socket head cap screw protrusion of the modified ski and climbing skin plate kit of the present invention.
Figure 22B:
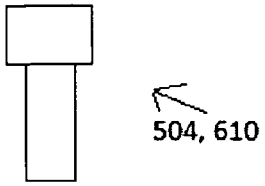
FIG. 22B is a side view of the preferred socket head cap screw protrusion of the modified ski and climbing skin plate kit of the present invention.
Figure 23:
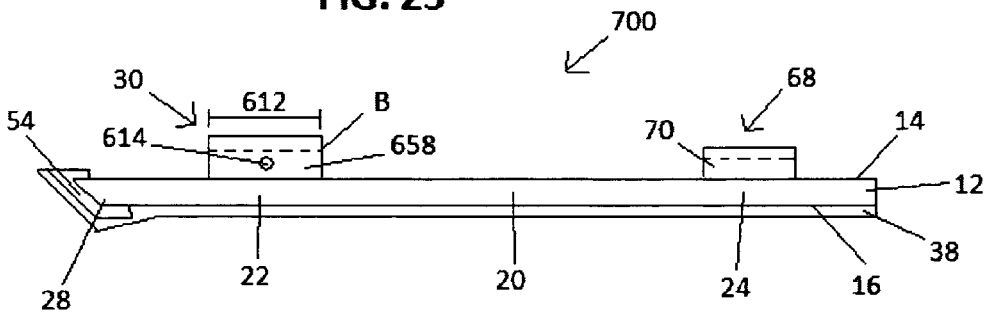
FIG. 23 is a side view of the preferred rigid plate and front bracket of the climbing skin plate kit of the present invention.
Figure 24:
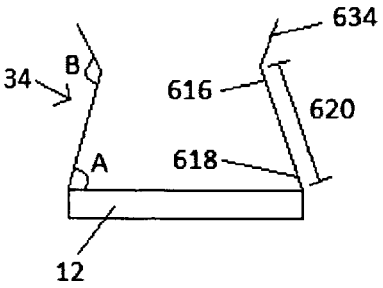
FIG. 24 is a cut away view of the preferred rigid plate and front bracket of the climbing skin plate kit of the present invention.

Now referring to FIGS. 23 and 24, preferred rigid plate 12 and front bracket 30 of climbing skin plate kit 700 are shown. Modified ski 600 as shown in FIGS. 21A and 21B is also sometimes part of climbing skin plate kit 700. Protrusions 504, are always part of climbing skin plate kit 700. FIG. 23 is a side view of rigid plate 12. Rigid plate 12 includes top side 14, bottom side 16, where snow adhering substance 38 is disposed, right side 18 (shown in FIG. 26B, for example), left side 20, front area 22, where front bracket 30 is disposed, rear area 24, where rear bracket 68 is disposed, and bottom front edge 28, where diverter spring 54 is disposed. In this view we see outer front bracket side 658, hole 614, and length 612 of front bracket 30. Hole 614 is preferably disposed roughly in the center of length 612 of front bracket side 34, as shown. Hole 614 is sized so as to accommodate protrusion 504. Angle B, discussed in more detail below is shown as a dashed line. Rear bracket 68 includes rear bracket side 70.

FIG. 24 is a cut away view of rigid plate 12 with front bracket 30 applied. In this view, we see both front bracket sides 34, with height 630, top section 616, bottom section 618, lip 634, and angles A and B. Height 630 is preferably about ½". With this preferred height, the top sides of most skis 600 will be clipped into front bracket 30 by front bracket sides being at angle A from rigid plate 12. Angle A is preferably between 75° and 80° for this purpose. Angle B occurs at top section 616 of front bracket side 34 to create lip 634. Angle B is preferably between 115° and 135°. Lip 634 may be pressed upon, such as with the pole basket of the user's pole, to release ski 600 by effectively removing protrusion 504 from hole 614, so that the user may easily convert from climb mode to ski mode.

Figure 25:
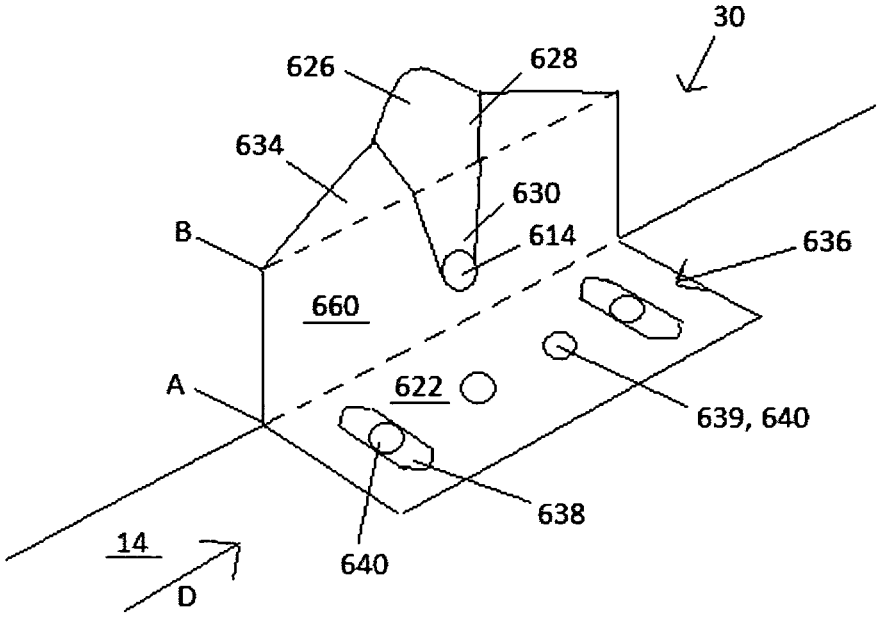
FIG. 25 is a perspective side of one side of the preferred rigid plate and front bracket of the climbing skin plate kit of the present invention.

Now referring to FIG. 25, a perspective view of one side of a preferred front bracket 30 is shown. It is understood that the other side of front bracket 30 is a mirror image of what is shown, attached to the other side of rigid plate 12. The other side is omitted from this view for clarity of the image. In this view we see inner front bracket side 660 attached to base portion 622 at angle A, which is shown in dashed lines traversing length 612 of front bracket 30. Base portion 622 is flush with top side 14 of rigid plate 12. Angle B at top section 616 of front bracket side 34 is also shown in dashed lines. Adjustment means 636 include tracks 638 and holes 639 with adjustment screws 640. A user will move front brackets 30 to the correct position on rigid plate 12 so as to properly accommodate bottom side width 606 of ski 600. The user will then apply adjustment screws 640 to tracks 638 and holes 639 to affix front brackets 30 in that position. As shown, tracks 638 are roughly perpendicular to angle A. We also see lip 634 formed by angle B, and "V" shaped area of reduced thickness 626. Area of reduced thickness 626 includes wide portion 628 at the top of the "V" and narrow portion 630 at the bottom of the "V," intersecting with hole 614. Area of reduced thickness 626 catches and guides protrusions 502 on right and left sides 314, 316 of ski 600 into hole 614.

The user may place ski 600 so that protrusion 504 is anywhere within wide portion 628 of area of reduced thickness 626 and press down. Protrusion 504 will be guided into hole 614. With preferred protrusion 504, socket head cap screw 610, front bracket sides 34 will flex outward as socket head cap screw 610 moves through area of reduced thickness 626. Once socket head cap screw 610 is guided into hole 614, front bracket sides 34 flex back, effectively locking ski 600 in place both with socket head cap screw 610 through hole 610 and by angle A making it so that top section 616 of front bracket side 34 clips top side 602 of ski 600. With alternative preferred protrusion 504, bullet catches 502, front bracket sides 34 are not required to flex outward so much because bullet catches 502 retract. Although this is a slight advantage over the greater flexing required for socket head cap screw 610, because of the retraction characteristic of bullet catch 502, bullet catch 502 is more likely to release from hole 614 when not planned by the user.

Figure 26A:
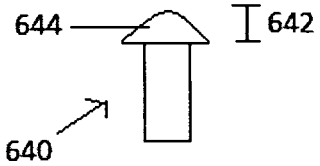
FIG. 26A is a side view of an adjustment screw of the preferred adjustment means of the climbing skin plate kit of the present invention.
Figure 26B:
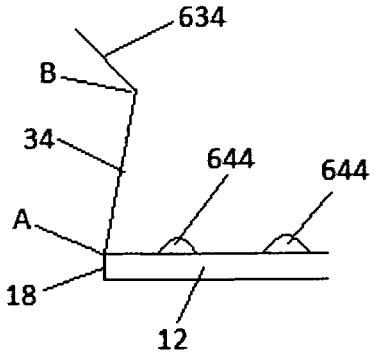
FIG. 26B is a cut away view as along arrow D as shown in FIG. 25, with no leveling surface.
Figure 26C:
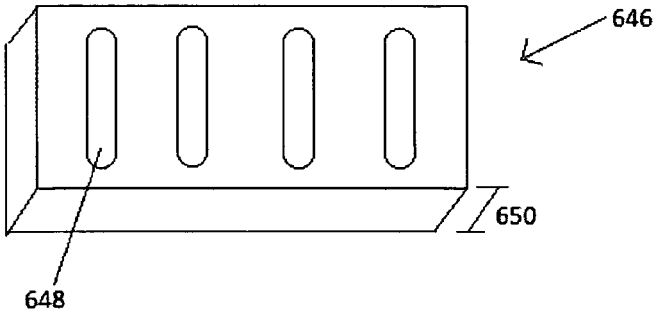
FIG. 26C is a leveling surface of the climbing skin plate kit of the present invention.
Figure 26D:
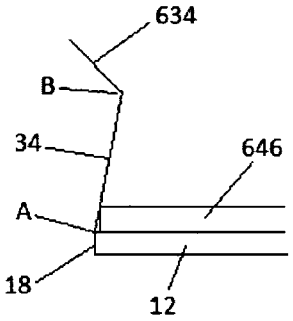
FIG. 26D is a cut away view as along arrow D as shown in FIG. 25, with a leveling surface.

Now referring to FIGS. 26A-26D, details of adjustment means 636 and leveling surface 646 are shown. FIGS. 26B and 26D are cut away views as viewed along arrow D shown in FIG. 25. FIG. 26A shows a side view of the preferred adjustment screw 640, which is a button head socket screw. Adjustment screw 640 has adjustment screw head 644, which has adjustment screw head height 642. Adjustment screw heads 644 make for a non-flush surface across base portion 622 and top side 14 of rigid plate 12, as shown in FIG. 26B. In order to make this surface flat, leveling surface 646, shown in FIGS. 26C and 26D, may be applied on top of this non-flat area. Leveling surface 646 is a piece of rubber with four tracks 648 cut into it. Leveling surface 646 has thickness 650, which is greater than or equal to adjustment screw head height 642. Tracks 648 are to provide a space for adjustment screw heads 644 wherever they are affixed within tracks 638 in base portion 622 and holes 639. As shown in FIG. 26D, because thickness 650 is greater than or equal to adjustment screw head height 642, leveling surface 646 provides a flat surface on top of rigid plate 12 and base portion 622.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

I claim:

1. A climbing skin plate kit for use with at least one ski, each ski of which comprises a top side, a bottom side, a bottom side width, a right side, and a left side, said climbing skin plate kit comprising:

at least one rigid plate attachable to the bottom side of the ski, wherein said rigid plate comprises a top side, a bottom side, a right side, a left side, a front area, a rear area, a bottom front edge, and a length of at least 6 inches as measured along said right side and said left side;

at least one front bracket attachable to said front area of said rigid plate, said front bracket comprising two front bracket sides through each of which is disposed a hole and each of which comprises a top section and a bottom section, wherein said at least one front bracket is attachable to said front area of said rigid plate such that said two front bracket sides are disposed on said right and left sides of said at least one rigid plate; and at least two protrusions sized and dimensioned to fit within said holes.

2. The climbing skin plate kit, as claimed in claim 1:

wherein said at least one front bracket is integral to said at least one rigid plate at said front area of said rigid plate such that said front bracket sides extend above said top side of said rigid plate on said right and left sides of said rigid plate;

wherein said front bracket sides and said at least one rigid plate form an angle of no more than 90°; and wherein said bottom sections of said front bracket sides are spaced so as to snugly accept the bottom side width of the at least one ski.

3. The climbing skin plate kit as claimed in claim 1, wherein said front bracket further comprises two base portions and an angle between said base portions and said front bracket sides of no more than 90°.

4. The climbing skin plate kit, as claimed in claim 3, further comprising adjustment means for attaching said front bracket to said rigid plate such that said bottom sections of said front bracket sides are spaced so as to snugly accept the bottom side width of the at least one ski.

5. The climbing skin plate kit, as claimed in claim 4, wherein said adjustment means comprise:

at least two tracks disposed through each of said base portions of said front bracket, and perpendicular to said angle of said front bracket; and at least two adjustment screws sized and dimensioned to fit in said at least two tracks.

6. The climbing skin plate kit, as claimed in claim 5, wherein each of said at least two adjustment screws of said adjustment means comprises an adjustment screw head with an adjustment screw head height, and further comprising a leveling surface, wherein said leveling surface:

comprises at least two parallel tracks, each of which is commensurate with said at least two tracks of said adjustment means;

comprises a thickness substantially equal to said adjustment screw head height;

is comprised of rubber; and is adherable to said base portions of said front bracket such that said adjustment screw heads are disposed within said at least two parallel tracks of said leveling surface when said adjustment screws are applied through said at least one track and said at least one hole in said base portions of said front brackets.

7. The climbing skin plate kit, as claimed in claim 1, wherein each of said front bracket sides comprises a substantially "V" shaped area of decreased thickness comprising a wide portion and a narrow portion, wherein said wide portion is disposed at said top section of each of said front bracket sides and said narrow portion intersects with said hole of each of said front bracket sides.

8. The climbing skin plate kit, as claimed in claim 1, wherein each of said top sections of said front bracket sides comprises an angle that creates a lip.

9. The climbing skin plate kit, as claimed in claim 8, wherein said angles at each of said top sections of said front bracket sides are between 115° and 135°.

10. The climbing skin plate kit, as claimed in claim 1, further comprising a rear bracket attachable to said rear area of said rigid plate, said rear bracket comprising two rear bracket sides.

11. The climbing skin plate kit, as claimed in claim 1, further comprising at least one ski, comprising a right side, a left side, a top side, a bottom side, a bottom side width, and a front boot binding area, wherein said at least two protrusions are integratable with said right and left sides of said at least one ski such that said protrusions protrude no more than ¼" from said right and left sides of said at least one ski.

12. The climbing skin plate kit, as claimed in claim 11, wherein said protrusions are integrated with said at least one ski and protrude from said right and left sides of said ski at said front boot binding area.

13. The climbing skin plate kit, as claimed in claim 12, wherein said protrusions are socket head cap screws and protrude no more than ¼" from said right and left sides of said ski.

14. The climbing skin plate kit, as claimed in claim 1, further comprising at least one removable attachable crampon attachment.

15. The climbing skin plate kit, as claimed in claim 1, wherein said bottom side of said at least one rigid plate comprises at least one fin.

16. The climbing skin plate kit, as claimed in claim 1, further comprising a snow adhering substance affixable to said bottom side of said rigid plate.

17. The climbing skin plate kit as claimed in claim 1, further comprising a diverter spring integral to said bottom front edge of said rigid plate.

18. The climbing skin plate kit as claimed in claim 1, wherein said at least one rigid plate further comprises at least two sections and a foldable connecting device between each of said at least two sections.

* * * * *